US012790070B2

(12) United States Patent
Maloney et al.

(10) Patent No.: US 12,790,070 B2
(45) Date of Patent: Nov. 10, 2026

(54) REDUCED WEIGHT PACKAGING SYSTEM FOR INDUSTRIAL EQUIPMENT

(71) Applicant: Siemens Energy Global GmbH & Co. KG, Munich (DE)

(72) Inventors: Gavin Maloney, Toronto (CA); Adam Jaffe, Brooklyn, NY (US); Raimondas Guobys, Kaunas (LT); Robert A. Buckenberger, Granville, OH (US); Jose L. Gilarranz, Katy, TX (US); Ali Shanian, Notre-Dame-de-I'Île-Perrot (CA); David Ransom, San Antonio, TX (US); William C. Maier, Almond, NY (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 19/106,700

(22) PCT Filed: Oct. 25, 2022

(86) PCT No.: PCT/US2022/078618
§ 371 (c)(1),
(2) Date: Feb. 26, 2025

(87) PCT Pub. No.: WO2024/091265
PCT Pub. Date: May 2, 2024

(65) Prior Publication Data

US 2026/0062171 A1 Mar. 5, 2026

(51) Int. Cl.
*B65D 6/02* (2006.01)
*B65D 6/14* (2006.01)
(Continued)

(52) U.S. Cl.
CPC ..... *B65D 9/06* (2013.01); *B65D 9/30* (2013.01); *B65D 9/34* (2013.01); *B65D 85/68* (2013.01);
(Continued)

(58) Field of Classification Search
CPC ... B65D 9/06; B65D 9/00; B65D 9/12; B65D 19/02; B65D 19/385; B65D 19/14
See application file for complete search history.

(56) References Cited

U.S. PATENT DOCUMENTS 8,733,726 B2 5/2014 Maier
8,813,500 B2 8/2014 Maier
(Continued)

FOREIGN PATENT DOCUMENTS

AU 4991179 A 2/1981
JP H06229499 A 8/1994
KR 101892452 B1 8/2018

OTHER PUBLICATIONS

PCT International Search Report and Written Opinion of International Searching Authority mailed Jun. 23, 2023 corresponding to PCT International Application No. PCT/US2022/078618 filed Oct. 25, 2022.

*Primary Examiner* — Jeffrey R Allen
(74) *Attorney, Agent, or Firm* — Enrique J. Mora

(57) ABSTRACT

A reduced weight packaging system for industrial equipment is provided. The packaging system includes a first module that defines a baseplate. A second module is superimposable on the baseplate. The second module defines an interior where the industrial equipment is to be housed during operation. At least a first portion of the first module is made from a wood-based material, such as mass timber, and the second module is made from the wood-based material. The packaging system may be designed to achieve at least the same strength ratings as non-wood materials like concrete
(Continued)

and steel while maintaining a relatively lighter weight and reducing carbon emissions based on the reduced carbon footprint of wood-based construction materials compared to such non-wood materials.

21 Claims, 8 Drawing Sheets

(51) Int. Cl.
*B65D 6/34* (2006.01)
*B65D 85/68* (2006.01)

(52) U.S. Cl.
CPC .. *B65D 2205/02* (2013.01); *B65D 2585/6877* (2013.01)

(56) References Cited

U.S. PATENT DOCUMENTS

| | | | | |
|---|---|---|---|---|
| 9,366,268 | B2 | 6/2016 | Maier et al. | |
| 11,174,095 | B1 * | 11/2021 | Schiltz | B65B 23/20 |
| 2015/0225114 | A1 * | 8/2015 | Sirowatka | B65D 9/18 217/13 |
| 2018/0186442 | A1 | 7/2018 | Maier | |
| 2019/0135487 | A1 * | 5/2019 | Ramon | B65D 19/385 |

* cited by examiner

REDUCED WEIGHT PACKAGING SYSTEM FOR INDUSTRIAL EQUIPMENT

BACKGROUND

Disclosed embodiments relate generally to industrial equipment, and, more particularly, to a reduced weight packaging system for industrial equipment. Disclosed embodiments are based on structural arrangements made from wood-based construction materials, such as mass timber.

SUMMARY

In one aspect, a reduced weight packaging system for industrial equipment is provided. The packaging system includes a first module that defines a baseplate. A second module is superimposable on the baseplate. The second module defines an interior where the industrial equipment is to be housed during operation. At least a first portion of the first module is made from a wood-based material and the second module is made from the wood-based material.

In another aspect, such as where the industrial equipment may comprise turbomachinery equipment, the packaging system may further include a third module superimposable on the second module. The third module may define a plenum to convey a flow of intake main air, such as combustion air, to the turbomachinery. The third module may further include venting equipment to convey venting air to the interior defined by the second module.

The foregoing has broadly outlined some of the technical features of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiments disclosed as a basis for modifying or designing other structures for carrying out the same purposes of the present disclosure. Those skilled in the art will also realize that such equivalent constructions do not depart from the spirit and scope of the disclosure in its broadest form.

Also, before undertaking the Detailed Description below, it should be understood that various definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

DETAILED DESCRIPTION

Figure 1:
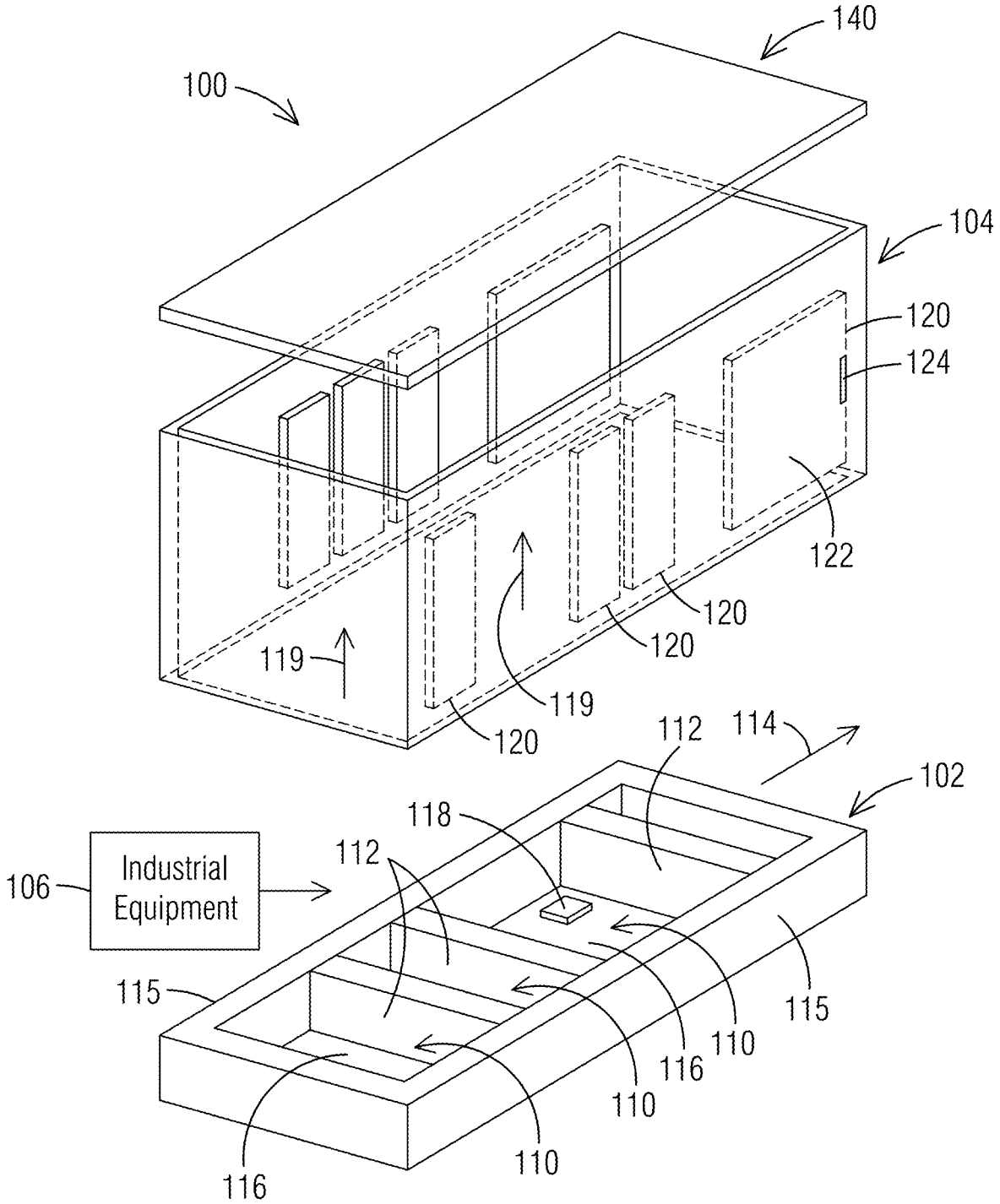
FIG. 1 is an exploded isometric view of one embodiment of a reduced weight packaging system for industrial equipment.

The present inventors have recognized that known packaging designs for industrial equipment generally rely on construction practices involving substantial utilization of energy intensive materials and/or involving relatively heavy materials, such as steel for enclosures and concrete for underlying support structures. Although certain attempts have been made involving packaging designs that may make use of lighter Fiberglas Reinforced Plastics (FRP) materials instead of steel for the enclosures, such designs still involve a relatively high carbon footprint and rank poorly in sustainability.

At least in view of the foregoing considerations, disclosed embodiments provide an innovative and cost-effective packaging system that utilizes sustainable wooden construction materials, such as mass timber, while maintaining or exceeding packaging performance in terms of weight reduction, noise reduction and affordability. A sustainable material, such as a wooden construction material, is a material that may be used throughout our consumer and industrial economy and that can be produced in required volumes without depleting non-renewable resources and without disrupting the established steady-state equilibrium of the environment and key natural resource systems.

Before any disclosed embodiments are explained in detail, it is to be understood that each disclosed embodiment is not limited in its application to the details of construction and the arrangement of components set forth in this description or illustrated in the following drawings. Each disclosed embodiment may be realized by other embodiments and of being practiced or of being carried out in various ways. Also, it is to be understood that the phraseology and terminology used herein is for the purpose of description and should not be regarded as limiting.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

It should be understood that the words or phrases used herein should be construed broadly, unless expressly limited in some examples. For example, the terms "including," "having," and "comprising," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

In addition, the term "adjacent to" may mean that an element is relatively near to but not in contact with a further element or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard is available, a variation of twenty percent would fall within the meaning of these terms unless otherwise stated.

None of the description in the present application should be read as implying that any particular element, step, act, or function is an essential element, which must be included in the claim scope. The scope of patented subject matter is defined only by the allowed claims. Moreover, none of these claims are intended to invoke a means plus function claim construction unless the exact words "means for" are followed by a participle.

FIG. 1 is an exploded, isometric view of one example embodiment of a disclosed reduced weight packaging system 100 for industrial equipment. In one example embodiment, a first module 102 defines a baseplate and a second module 104 is superimposable on the baseplate. Second module 104 defines an interior where the industrial equipment 106 is housed during operation.

The description below is provided in the context of an example embodiment involving turbomachinery equipment, as illustrated in FIGS. 2 through 6; it should be appreciated, however, that many forms of industrial equipment can benefit from disclosed embodiments, such as electrical grid equipment, energy storage equipment, power-to-X equipment, energy decarbonizing equipment, hydrogen production equipment and a combination of two or more of such equipment types. Power-to-X equipment may be defined as equipment configured to convert electricity, e.g., acting as the primary energy, into an energy carrier, heat, cold, product, or raw material. Accordingly, Power-to-X may be viewed as an umbrella term for different ways of generating energy, such as power-to-gas, power-to-liquid, power-to-fuel, power-to-chemicals and power-to-heat. The foregoing is not meant to be an exhaustive list of examples of industrial equipment that can benefit from our disclosed embodiments but, as noted above, it is just an illustrative list of various forms of industrial equipment that can benefit from our disclosed embodiments.

In one non-limiting embodiment, at least a first portion of the first module 102 is made from a wood-based material and the second module 104 is made from the wood-based material. As noted above, the wood-based material may be mass timber (shortened form of "massive timber") that may comprise engineered wood, solid wood or both. In one example embodiment, the first module 102 may be entirely made up of mass timber. Mass timber construction is a construction technique effective to create strong and sustainable structural elements, such as panels, planks, posts, beams, etc. Mass timber materials may be designed to achieve at least the same structural strength ratings as non-wood materials like concrete and steel while advantageously attaining a relatively lighter weight and reducing carbon emissions, such as based on the substantially reduced carbon footprint of mass timber materials compared to such non-wood materials.

Figure 7:
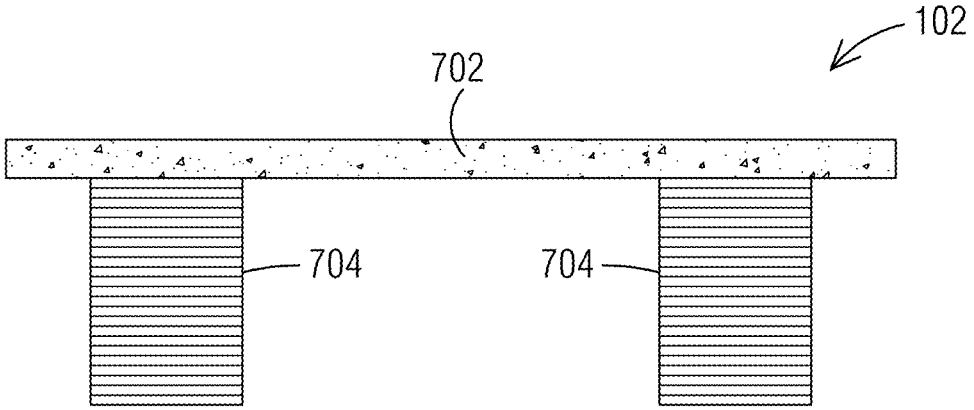
FIGS. 7 and 8 show respective sectional views of further disclosed embodiments of baseplates each involving respective hybrid structures.
Figure 8:
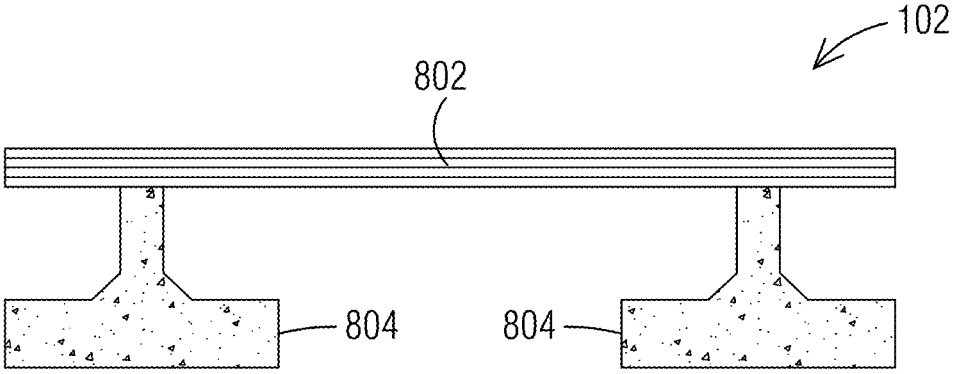

In certain applications, the first module 102 may comprise a hybrid structure, as may include a second portion made of concrete. FIGS. 7 and 8 show respective sectional views of example embodiments of baseplates each involving respective hybrid structures. FIG. 7 shows one example embodiment where the baseplate 102 is formed by a slab of concrete 702 supported by timber beams 704. FIG. 8 shows another example embodiment where the baseplate 102 is formed by a slab of timber 802 supported by concrete beams 804. Regardless of the specific implementation, it is expected that the weight of disclosed packaging systems may be reduced from approximately 40% to approximately 75% relative to comparable modules made of metal, concrete or both.

In one example embodiment, as may be appreciated in FIG. 1, the first module 102 comprises a number of cavities 110 (e.g., pits) defined in part by beams 112 transversely positioned relative to the longitudinal axis 114 of the packaging system. In one example embodiment, beams 112 extend between respective inner surfaces of mutually opposite sides 115 (extending along longitudinal axis 114) of a rectangular frame that defines the footprint of baseplate 102. In one example embodiment, the frame of the first module 102 including the beams 112 may be formed of glue-laminated timber (GLT). The beams 112 may be arranged to structurally support mounting points of the industrial equipment 106 to be housed in the interior defined by the second module 104. It will be appreciated that this arrangement may be conceptualized to an inverted decking floor arrangement and may be beneficial to, for example, locating piping structures and other peripheral equipment that may need to be accommodated proximate the bottom of the interior of the second module 104. Additionally, in certain applications this inverted decking floor arrangement may be conducive to improved distribution of venting air within the interior of the second module 104.

In one example embodiment, respective bottommost portions of cavities 110 are closed by a panel 116 that may be lined with a synthetic membrane (fragmentarily represented by rectangle 118), such as a geomembrane liner or barrier used to control fluid migration from the baseplate 102 of packaging system 100. Essentially, the geomembrane functions to, for example, contain potentially hazardous fluids, or any other substance that does not need to escape from a designated space, which in this case would be from the bottom of the interior of the second module 104.

In one example embodiment, the second module 104 comprises panels formed of cross-laminated timber (CLT), which may be assembled to form a monocoque structure. As would be appreciated by those skilled in the art, a monocoque structure involves a technique in which stresses are reacted by a singular shell structure (conceptually analogous to an eggshell), rather than involving a collection of structural beams. Consequently, this technique is conducive to further reducing the weight of the packaging system while maintaining its strength. In this case, the cross-laminated timber panels that form the second module 104 would handle the stresses and loads without making use of structural beams for strength and/or structural integrity.

In one example embodiment, the orientation of the lamellas (e.g., constituent layers) in the cross-laminated timber panels of the second module 104 may be arranged to maximize strength and stiffness along a desired direction, such as along a direction schematically represented by arrows 119. That is, in one example embodiment the lamellar orientation may be along a direction transversal relative to longitudinal axis 114. This example lamellar orientation is further effective to reduce the number of panel joints.

As may be appreciated in FIG. 1, at least some of the panels of the second module 104 have at least one of the following: an access opening or an access door (schematically represented by dashed line contours 120, where the respective access opening or the access door that is pre-cut from a respective panel is each closable with a respective removable plug 122 obtained from the respective panel of the second module 104. That is, the respective plug 122 is pre-cut from the respective panel to the desired shape of the access opening or the access door 120. This approach of re-using the cutouts from the panels of the second module 104 is effective to reduce waste. It will be appreciated that the dimensions (e.g., height, width), and relative positioning of the openings or doors are chosen to appropriately balance competing needs, such as the need of providing sufficient access while maintaining sufficient structural integrity in the CLT panels. In one example embodiment, the periphery of the respective plug 122 may include a respective seal (fragmentarily represented by solid line 124) so that the interior of the second module 104 comprises an airtight interior.

In one example embodiment, a roof panel 140 may be configured to define a sloping roof disposed at a topmost portion of the second module 104. The panel 140 may be made from CLT and may be lined with a water resistance membrane to further define the sloping roof. In one example embodiment the sloping roof may have a slope ratio in a range from 10:1 to 3:1. The slope ratio may be chosen to facilitate drainage of rainwater while providing sufficient headroom to users that need access to the interior of the module.

Figure 2:
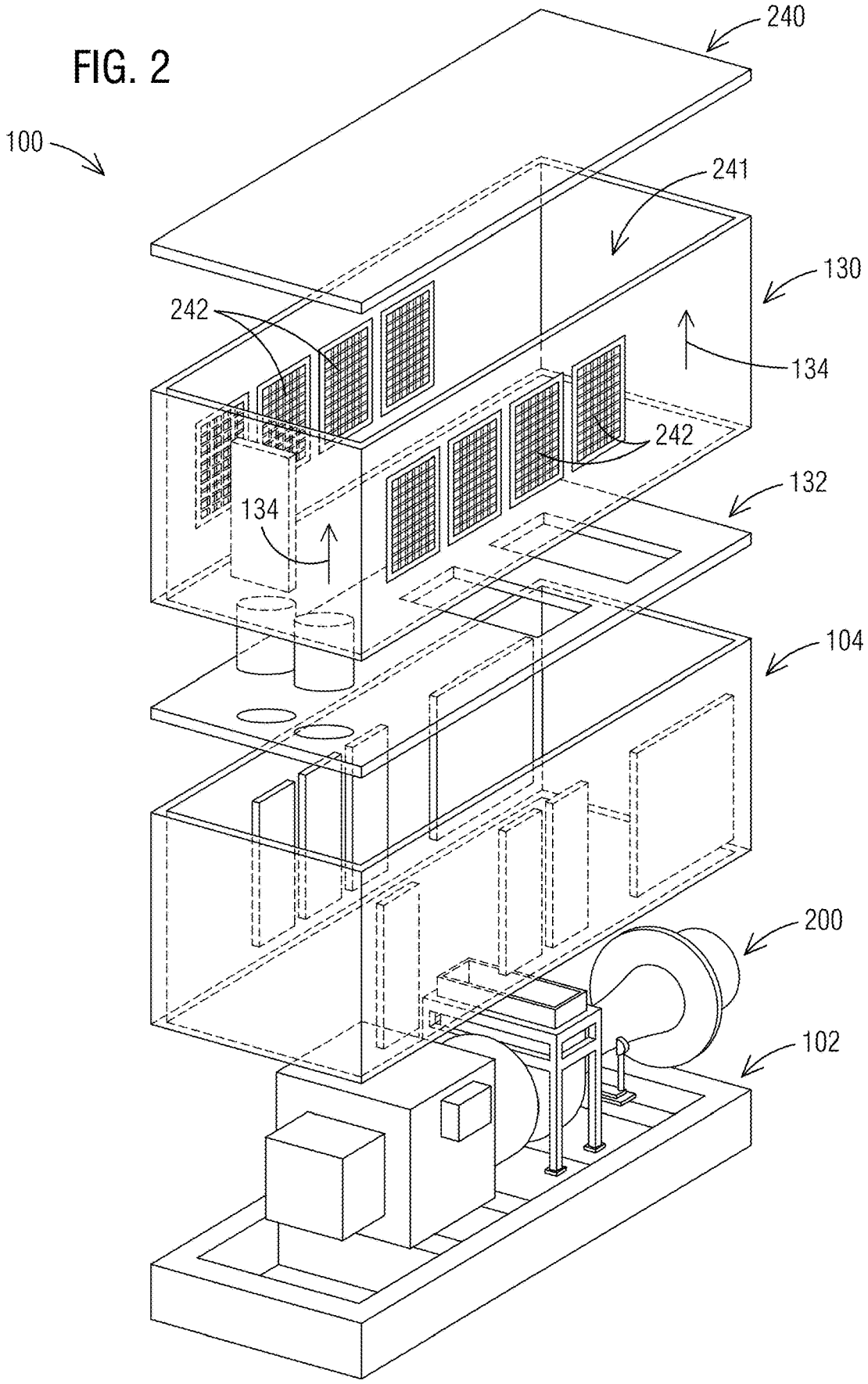
FIG. 2 is an exploded isometric view of another embodiment of the reduced weight packaging system where the industrial equipment may involve turbomachinery equipment.
Figure 3:
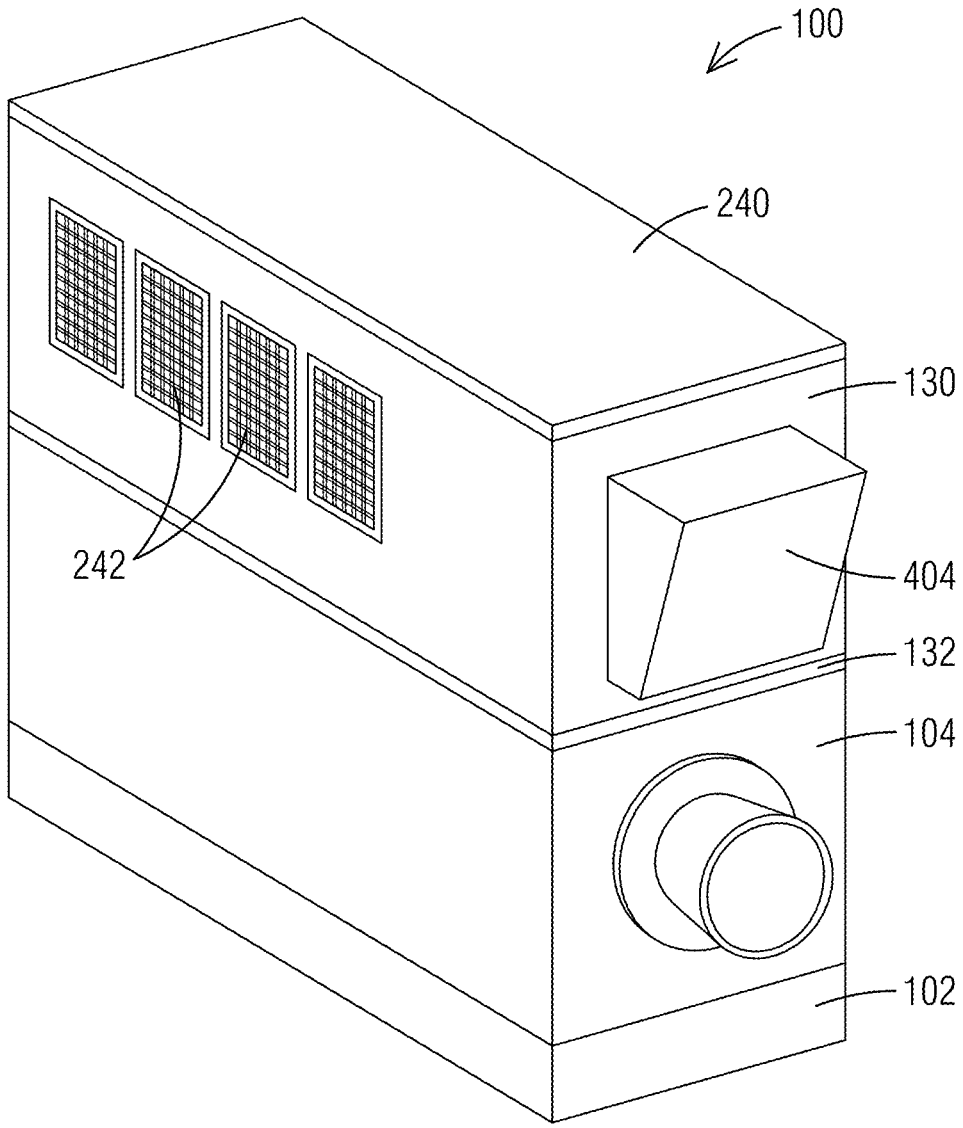
FIG. 3 is an assembled isometric view of the embodiment shown in FIG. 2.
Figure 4:
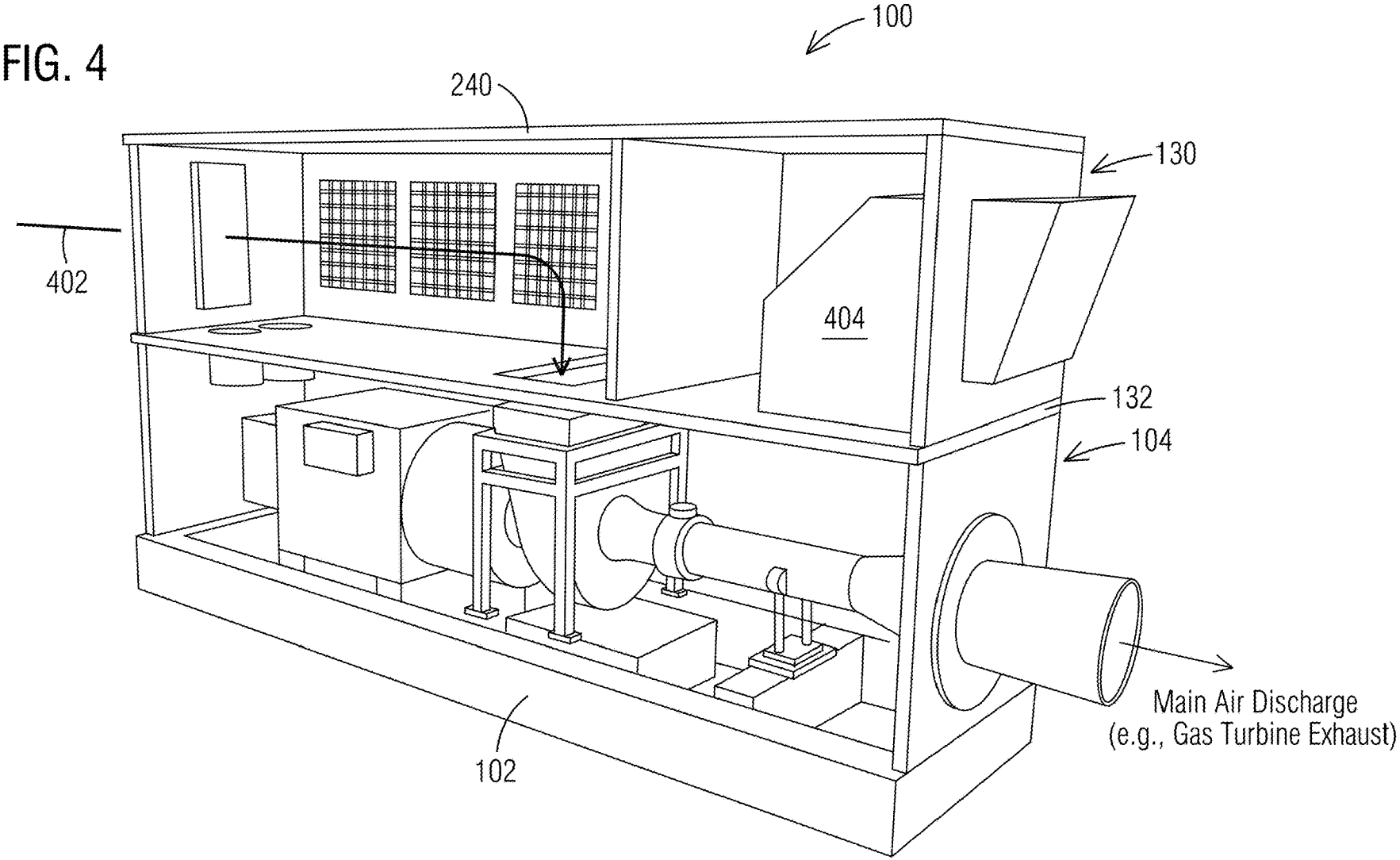
FIG. 4 is an assembled cut-away isometric view of the embodiment shown in FIG. 2.
Figure 5:
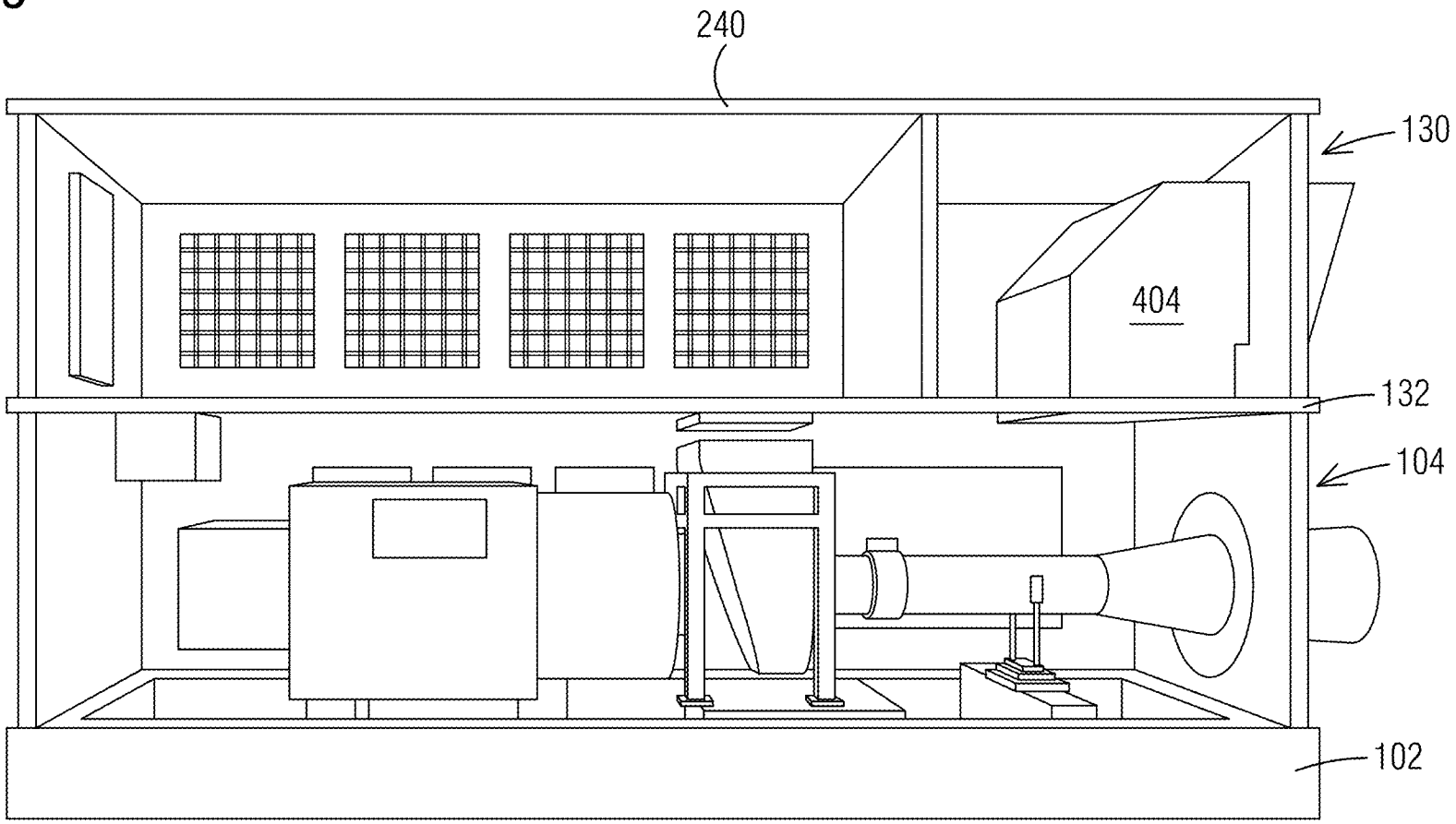
FIG. 5 is an assembled cut-away sideview of the embodiment shown in FIG. 2.

As may be appreciated in FIG. 2, in one example application involving turbomachinery equipment 200, the packaging system 100 may further comprise a third module 130 superimposable on the second module 104. In this example application (and other similar applications), the interior of the second module 104 may include a suitable lining (e.g., stone-wool insulation or similar insulation materials) to provide acoustic attenuation and thermal insulation.

In one example embodiment, an intermediate panel 132 (e.g., intermodular partition) may be stacked between the third module 130 and the second module 104, which is effective to improve the respective air tightness of the second module 104 and the third module 130.

In one example embodiment, as described above in the context of the second module 104, the third module 130 similarly comprises panels formed of CLT, which may be assembled to form a monocoque structure. In one example embodiment, the orientation of the lamellas in the CLT panels of the third module 104 may be chosen to maximize strength and stiffness along a desired direction, such as along a direction schematically represented by arrows 134. In one example embodiment, the third module 130 may include venting equipment 404 (FIGS. 3 and 4) to convey venting air to the interior defined by the second module 104.

In one example embodiment, the third module 130 (e.g., the overall volumetric footprint encompassed by the third module 130) defines a plenum 241 to convey an intake flow of main air (e.g., combustion air, etc.) to certain components of the turbomachinery. This flow is schematically represented by line 402 in FIG. 4. The plenum 241, being defined by the overall volumetric footprint of the third module 130, encompasses a relatively large volume and avoids use of separate conduits to convey such flow of main air. The relatively large size of the plenum 241 is conducive to reduce the velocity of the flow of main air and in turn is conducive to reduce noise and this further improves the acoustic performance of the packaging system, such as by way of the plenum effect. It is expected that acoustic performance of disclosed packaging systems may be reduced from approximately 10% to approximately 20% relative to comparable modules made of metal.

In certain embodiments, the third module 130, may include without limitation, respective air filters 242 for the main air and the ventilation air, respective intake silencers for the main air and the ventilation air and one or more exhaust silencers for the ventilation air. It will be appreciated that depending on the needs of a given application, in certain implementations, the second module 104 could house at least some of the foregoing components, such as one or more air filters for ventilation air, one or more intake silencers for ventilation air and one or more exhaust silencers for ventilation air. In one example embodiment, as may be appreciated in FIG. 2, the air filters 242 may be located on mutually opposite sides of the third module 130. This arrangement is beneficial to ameliorate the impact of varying wind conditions on the packaging system by inhibiting formation of large pressure differential between positive and negative pressure locations that could act on the mutually opposite sides of the module.

Figure 9:
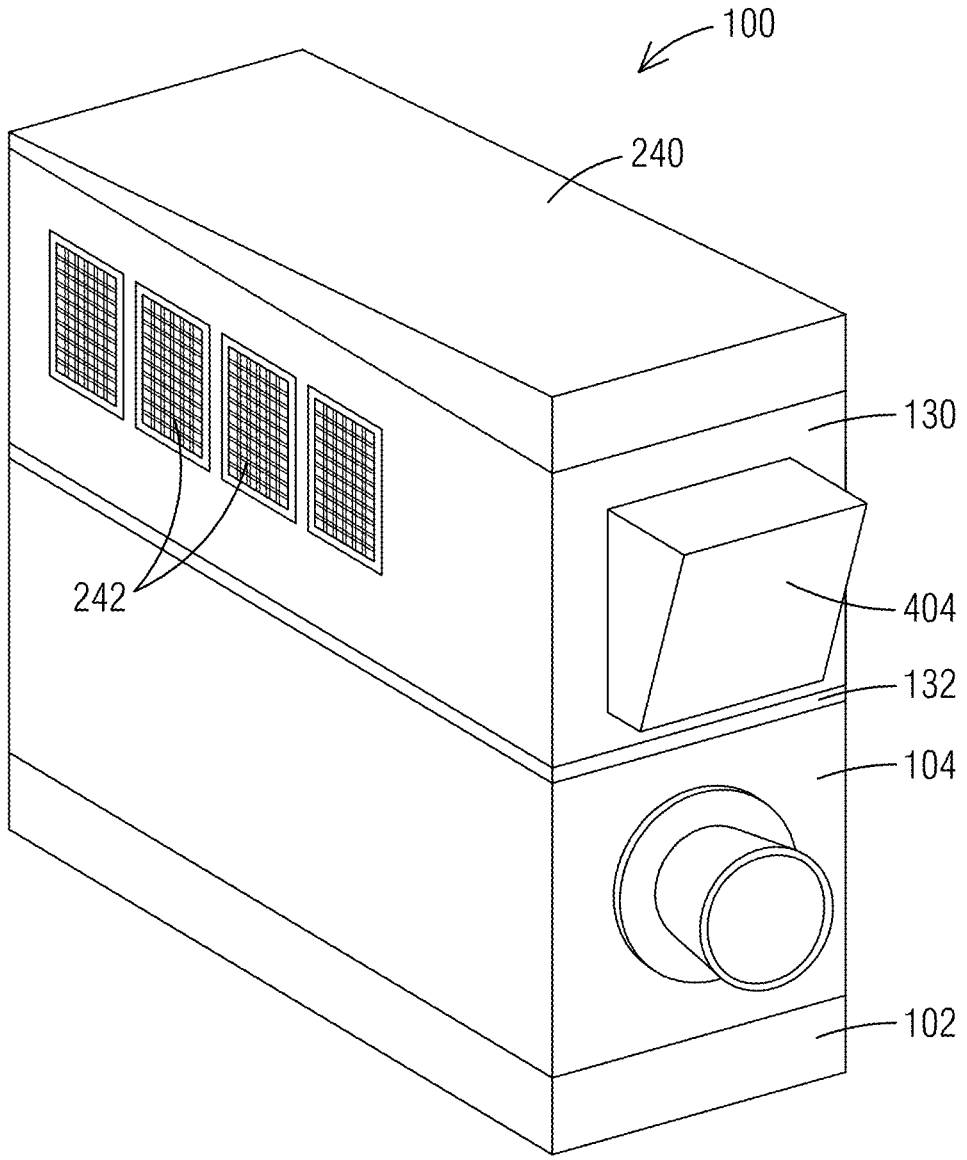
FIG. 9 is an isometric view of a packaging module having a sloping roof.

In one example embodiment, as shown in FIG. 9, a roof panel 240 may be configured to define a sloping roof disposed, in this example, at a topmost portion of the third module 130. As noted above, the roof panel 240 may be made from CLT and may be lined with a water resistance membrane to further define the sloping roof. In one example embodiment the sloping roof may have a slope ratio in a range from 10:1 to 3:1.

Figure 6:
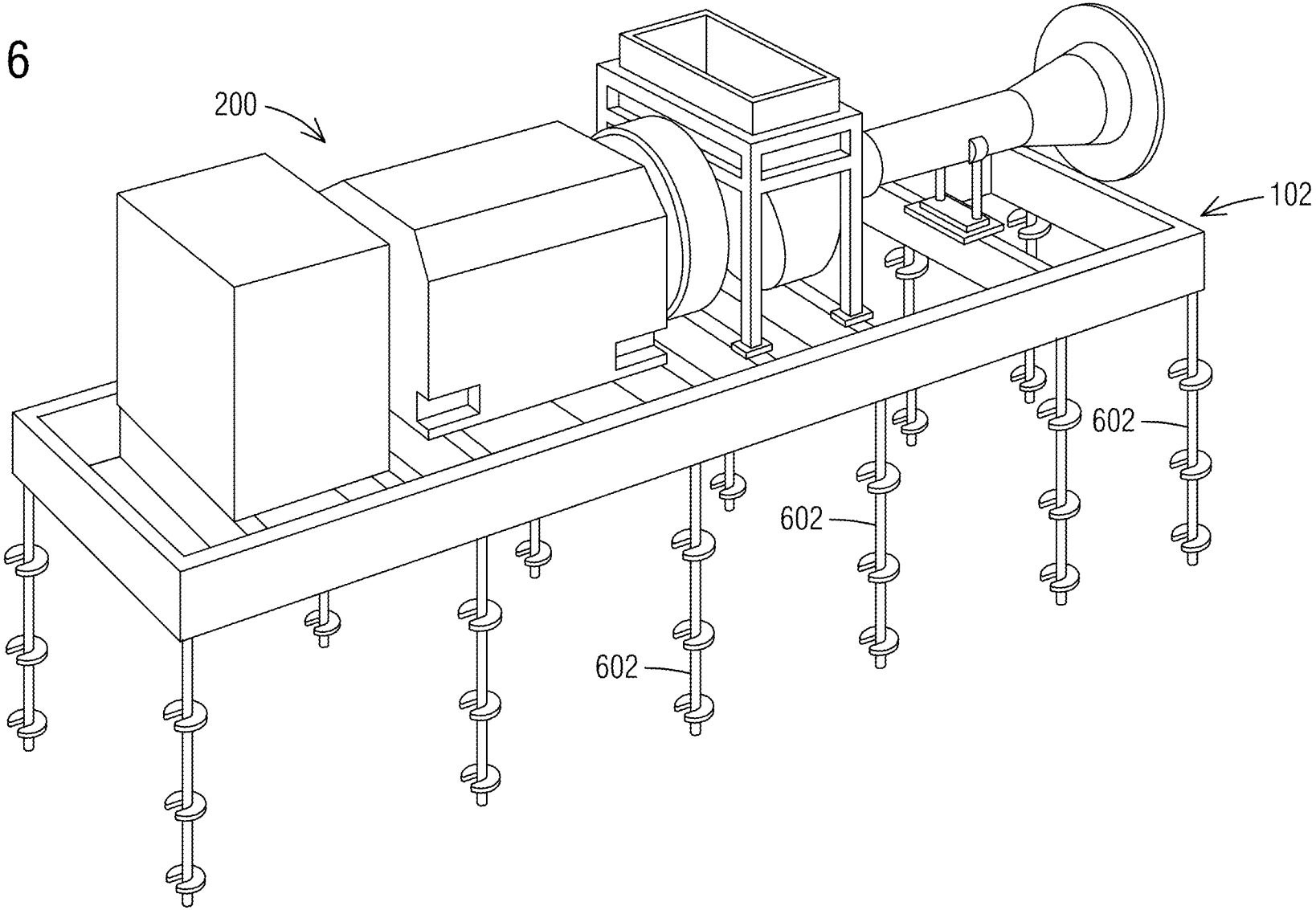
FIG. 6 is an isometric view showing one example embodiment where a disclosed baseplate is supported by helical pilings.

As may be appreciated in FIG. 6, in one example embodiment the baseplate 102, e.g., made from GLT, may be supported by a plurality of helical pilings 602, which may be conducive to increase the durability of the mass timber, such as by way of appropriate separation from ground moisture and reducing the impact of the packaging system on the environment by way of reduced site preparation work and minimal residual cleanup efforts during a decommissioning phase.

In operation, disclosed embodiments of our wood-based packaging system for industrial equipment, when compared with known packaging designs that make substantial use of non-wood materials such as steel and concrete, achieve at least the same strength ratings as such non-wood materials while attaining a relatively lighter weight and reducing carbon emissions based on the reduced carbon footprint of wood-based construction materials compared to such non-wood materials.

Additionally, disclosed embodiments make use of a renewable material resource in which carbon is stored. Trees take in CO2 via photosynthesis in order to grow. This stored carbon in wooden biomass is referred to as 'biogenic storage'. Approximately 50% of the tree biomass consists of stored carbon. Consequently, one of the additional benefits of our disclosed wood-based packaging system is not only reducing emissions but creating negative emissions through carbon sequestration, which is conducive to reducing greenhouse gas (GHG) emissions, which could provide an important contribution to slowing down climate change.

In operation, disclosed embodiments are effective to further mitigate emissions due to the reduced weight of mass timber, which leads to reduced transport emissions due to lower transportation load weigh compared to non-wood materials such as steel and concrete.

Although at least one exemplary embodiment of the present disclosure has been described in detail, those skilled in the art will understand that various changes, substitutions, variations, and improvements disclosed herein may be made without departing from the scope of the disclosure in its broadest form.

What is claimed is:

1. A reduced weight packaging system for industrial equipment:

a first module defining a baseplate, wherein the first module comprises a number of cavities defined in part by beams transversely positioned relative to a longitudinal axis of the packaging system, and wherein respective bottommost portions of the cavities are closed by a panel lined with a geomembrane; and a second module superimposable on the baseplate, the second module defining an interior where the industrial equipment is to be housed during operation, wherein the geomembrane lines the panel to define a fluid containment boundary forming a bottom of the interior of the second module, the geomembrane being configured to retain fluid originating from the interior of the second module, wherein at least a first portion of the first module is made from a wood-based material and wherein the second module is made from the wood-based material.

2. The packaging system of claim 1, wherein the wood-based material comprises mass timber.

3. The packaging system of claim 1, wherein the first module is entirely made of mass timber.

4. The packaging system of claim 1, wherein the first module comprises a hybrid structure further comprising a second portion of concrete.

5. The packaging system of claim 1, wherein a weight of the packaging system is reduced from 40% to 75% relative to a reference packaging system configured to house the same industrial equipment, the reference packaging system being formed of metal, concrete, or a combination thereof.

6. The packaging system of claim 1, wherein the second module comprises panels formed of cross-laminated timber assembled to form a monocoque structure.

7. The packaging system of claim 1, wherein the beams are distributed to structurally support mounting points of the industrial equipment to be housed in the interior defined by the second module, the mounting points being positioned such that loads from the industrial equipment are transmitted through the beams to the baseplate.

8. The packaging system of claim 1, wherein the geomembrane is arranged to collect and retain hazardous fluids released from the industrial equipment and to prevent leakage of the hazardous fluids through the baseplate.

9. The packaging system of claim 1, wherein a frame and the beams of the first module are formed of glue-laminated timber.

10. The packaging system of claim 1, wherein the second module comprises panels formed of cross-laminated timber.

11. The packaging system of claim 1, wherein the industrial equipment comprises turbomachinery equipment.

12. The packaging system of claim 11, wherein the packaging system further comprises a third module superimposable on the second module, the third module defining a plenum to convey a flow of main air to the turbomachinery.

13. The packaging system of claim 12, wherein the third module further comprises venting equipment to convey venting air to the interior defined by the second module.

14. The packaging system of claim 11, further comprising a roof panel defining a sloping roof disposed at a topmost portion of the second module or the third module, the panel lined with a water resistance membrane.

15. The packaging system of claim 14, wherein the sloping roof has a slope ratio in a range from 10:1 to 3:1.

16. The packaging system of claim 10, wherein at least some of the panels of the second module have at least one of the following: an access opening or an access door, wherein the access opening or the access door is each closable with a respective plug obtained from a respective panel of the at least some of the panels of the second module, the respective plug being pre-cut from the respective panel to a desired shape of the access opening or the access door.

17. The packaging system of claim 16, wherein a periphery of the respective plug having a respective seal so that the interior of the second module comprises an airtight interior.

18. The packaging system of claim 13, wherein the third module comprises panels formed of cross-laminated timber.

19. The packaging system of claim 18, wherein at least some of the panels of the third module have at least one access opening, wherein the access opening is each closable with a respective plug obtained from a respective panel of the at least some of the panels of the third module, the respective plug being pre-cut from the respective panel to a desired shape of the access opening or the access door.

20. The packaging system of claim 1, wherein at least some of the panels of the second module have a liner arranged to provide acoustic attenuation and/or thermal insulation.

21. The packaging system of claim 1, wherein the industrial equipment is selected from the group consisting of turbomachinery equipment, electrical grid equipment, energy storage equipment, power-to-X equipment, energy decarbonizing equipment, hydrogen production equipment and a combination of two or more of said equipment types.

* * * * *